US006788208B2

(12) United States Patent
Dittmer

(10) Patent No.: US 6,788,208 B2
(45) Date of Patent: Sep. 7, 2004

(54) METHOD FOR CONTROLLING STATIONARY FIRE-EXTINGUISHING SYSTEMS

(75) Inventor: Hauke Dittmer, Puttgarden (DE)

(73) Assignee: Minimax GmbH, Bad Oldesloe (DE)

( * ) Notice: Subject to any disclaimer, the term of this patent is extended or adjusted under 35 U.S.C. 154(b) by 0 days.

(21) Appl. No.: 10/356,083

(22) Filed: Jan. 31, 2003

(65) Prior Publication Data

US 2003/0146843 A1 Aug. 7, 2003

(30) Foreign Application Priority Data

Feb. 4, 2002 (DE) ..... 102 04 384

(51) Int. Cl.[7] ..... G08B 17/00

(52) U.S. Cl. ..... 340/584; 340/577; 340/578; 340/587; 340/588; 340/589; 340/286.05; 340/289; 340/304; 340/628; 340/629; 340/630

(58) Field of Search ..... 340/577, 578, 340/587–589, 286.05, 289, 304, 628–630, 511, 521–522

(56) References Cited

U.S. PATENT DOCUMENTS

| | | | | |
|---|---|---|---|---|
| 4,785,283 A | * | 11/1988 | Yuchi | 340/501 |
| 5,486,811 A | * | 1/1996 | Wehrle et al. | 340/522 |
| 5,548,276 A | * | 8/1996 | Thomas | 340/578 |
| 6,154,142 A | | 11/2000 | Kosugi et al. | 340/589 |

FOREIGN PATENT DOCUMENTS

| | | |
|---|---|---|
| DE | 23 44 908 | 3/1975 |
| DE | 41 42 419 | 7/1992 |
| DE | 196 27 353 | 10/1997 |
| DE | 199 52 327 | 5/2000 |
| DE | 199 35 308 | 3/2001 |
| DE | 100 12 705 | 10/2001 |
| GB | 2 251 684 | 7/1992 |

* cited by examiner

*Primary Examiner*—Daniel J. Wu
*Assistant Examiner*—Samuel J. Walk
(74) *Attorney, Agent, or Firm*—Collard & Roe, P.C.

(57) ABSTRACT

A method and a fire-alarm system controls stationary fire-extinguishing systems. The fire-alarm devices of the fire-alarm system are equipped with one or more detectors. If at least one pre-adjustable alarm threshold of a fire identification characteristic is reached, the fire-extinguishing device is activated and the fire detectors are selectively switched to a higher stage of sensitivity. The detectors to be switched are locally selected depending on the actual development of the fire in terms of space. The dynamic adaptation of the sensitivity of the detectors to the development of a fire permits analyzing the development of the fire through the generated smoke, water vapor or extinguishing-water mist, and to influence the fire-extinction process in a targeted manner. The fire-extinction process and the development of the fire in terms of time can be effectively adapted in this manner, which contributes to a reduction of the amount of fire-extinguishing used and of the damage caused by the fire-extinguishing agent to persons and valuable materials.

6 Claims, 2 Drawing Sheets

METHOD FOR CONTROLLING STATIONARY FIRE-EXTINGUISHING SYSTEMS

CROSS REFERENCE TO RELATED APPLICATIONS

Applicant claims priority under 35 U.S.C. §119 of German Application No. 102 04 384.1 filed Feb. 4, 2002.

BACKGROUND OF THE INVENTION

1. Field of the Invention

The present invention relates to a method for controlling stationary fire-extinguishing systems, and in particular for controlling fire-extinguishing installations that are operated with liquid or gaseous fire-extinguishing agents. In addition to the fire-extinguishing devices which dispense liquid or gaseous fire-extinguishing agents, the important components of stationary fire-extinguishing systems are the fire alarm devices for controlling fire-extinguishing installations. Such fire-alarm devices are in the center of the present invention.

2. The Prior Art

Fire-extinguishing systems include a reservoir of fire-extinguishing liquid or gaseous agents that is connected with a monitored area (building, warehouse, etc.) via a more or less branched system of pipelines. In the event of a fire, the extinguishing agents are released by means of fire-extinguishing nozzles. The nozzles are arranged in accordance with the specific fire-extinguishing task on hand.

Depending on the type of fire hazard involved and the areas that have to be protected, widely branched sprinkler systems or fine-spray fire extinguishing systems are employed that produce a highly effective water mist. Also gas fire-extinguishing systems may be used which operate with an inert gas such as carbon dioxide as the fire-extinguishing agent.

To fight a fire effectively, the point or points at which the various types of fire-extinguishing systems are triggered plays a special role.

This task is assumed by fire-alarm systems that, in most cases, are equipped with detectors for an early detection of various fire identification characteristics.

Such fire-alarm systems include one or more detectors that are accommodated in fire-alarm devices. The devices are often connected with a fire-alarm center via signal lines (fire alarm lines).

Fire-alarm installations are in most cases built from a great number of sturdy fire-alarm devices.

The detectors react to the occurrence or change in measurable fire identification characteristics such as the temperature, the radiation, particulate matter (aerosols), or gases characterizing a fire.

In the fire alarm center, the measurement signals received from the fire-alarm devices installed in the monitored areas of the fire-extinguishing system are processed, and, in the event of an alarm, corresponding control commands are transmitted to the fire-extinguishing system.

All physical or chemical changes of condition parameters occurring in the area monitored by a fire-alarm system that are caused by a fire and can be detected by means of sensor elements or detectors are summarized herein under the term "fire identification characteristics".

Thus the fire identification characteristics are condition parameters of the fire. These parameters include, for example, the ambient temperature, the composition of the gas (smoldering or combustion gases), the density of optically detectable smoke or soot particles (aerosols), and the electromagnetic radiation emitted by fires on different wavelengths.

Stationary fire-extinguishing systems are successfully employed for fire-fighting purposes in many areas of fire protection in buildings, equipment installations, or in the area of warehousing of materials.

It is known that the fire-extinguishing process is triggered and the fire-extinguishing agents are released by automatically operating fire-alarm devices.

So that the start of a fire can be detected early, the fire-alarm devices should be installed as closely as possible to a site where a fire may possibly originate, on the one hand. On the other hand, however, the local circumstances have to be taken into account as well.

In this connection, in addition to the early detection of fires, the prevention of false fire alarms as well is the focus of the further development of fire-alarm devices.

False fire alarms are frequently triggered by uncritical parameters or processing process-conditioned sources. A rise in the temperature within the vicinity of a heat-alarm device that cannot be attributed to the start of a fire may lead to a false alarm as well.

With many conventional fire-extinguishing systems, the entire supply of fire-extinguishing agents is often consumed without interruption after a fire alarm has been triggered and the extinguishing process has been activated.

However, such extensive fire-extinguishing measures are normally not required in connection with smaller, locally confined fires.

False alarms cause even greater damage: not only will the consumed supplies of fire-extinguishing agent ($CO_2$-gas), which are available only to a limited extent in connection with certain fire-extinguishing systems, need to be replaced at high cost and with great expenditure of time, but also the fire-extinguishing agents unnecessarily dispensed may cause damage to persons and equipment, or may shut down entire manufacturing areas.

Numerous proposals have been made for resolving these known problems associated with the operation of stationary fire-extinguishing installations.

DE 100 12 705 A1 discloses a method and a device for the early detection and fighting of fire in indoor and outdoor areas, in particular in the area of residential houses and of buildings. The system includes a fire-extinguishing device and a fire alarm system that has one or more fire alarm devices with at least one detector. The detectors detect the same or different fire identification characteristics and trigger a fire-alarm signal after one or more pre-adjustable alarm thresholds of the detected fire identification characteristics have been exceeded. This fire-alarm signal then activates the fire-extinguishing system.

A method and a system for detecting fire in a monitored room (or space) with the possibility of increasing the sensitivity of the detector system are known from DE 41 42 419 A1. An undefined number of detectors are switched with respect to their sensitivity, and the number of detectors to be switched over is adapted to the further development of the fire.

A method for automatically reporting and extinguishing fires is known from DE 23 44 908 C2. In this process, the fire-extinguishing system is controlled and actuated only after a flame report is available. This report has to be preceded by two smoke reports and one heat report. The continuing presence of flames has to be tested in this connection at defined time intervals by a flame-reporting alarm device, and the dispensation of the fire-extinguishing agent either has to be maintained or shut down. However, it is not stated how exactly this testing procedure is carried out. The aim of this known method is to prevent false alarms and damage caused by any unnecessary influence of fire-extinguishing agent.

A similar fire-extinguishing method is described in DE 196 27 353 C1. In this method, the development of the fire is detected by sensors distributed over the room and the fire-extinguishing agent is dispensed in a manner adapted according to the development of the fire in terms of space.

DE 199 52 327 A1 discloses a fire sensor and a method for detecting a fire as well. The smoke signal emitted by the fire sensor is additionally corrected by correlating actual outside temperature and the rate at which the temperature is rising.

The purpose of such a correction is to adapt the smoke detection sensitivity of the sensor to the ambient temperature and the rate at which the ambient temperature is changing.

The probability of a false alarm is expected to be reduced by this method, and early triggering of the alarm is said to be achievable at the same time.

However, this patent document relates to the detection of fires only up to the activation of the fire-extinguishing system and contains no reference to the fire-extinguishing process and the control of the fire-extinguishing system after the alarm has been triggered.

The known fire-extinguishing systems have the drawback that they fail to take into account the physical and chemical changes caused by a fire and the extinction process that starts within the environment of the fire alarm device, such as a strong development of smoke, soot particles, temperature changes caused by the influence of the fire-extinguishing agent or water mists, as well as changes occurring in the composition of the gas etc. Without taking into account these changes within the area of a fire, conventional fire alarm devices cannot supply any adequately exact picture of the actual fire event and are only conditionally suited for controlling the fire-extinguishing process.

SUMMARY OF THE INVENTION

Therefore, the object of the present invention is to develop a method for controlling stationary fire-extinguishing systems, and to specify how such systems are operated, that eliminates the aforementioned drawbacks.

The method of the invention generates measurement signals that can be easily evaluated, are suitable for controlling the fire-extinguishing system despite changes occurring in the environmental conditions in the event of a fire, and can be used for effectively controlling the fire-extinguishing process.

In accordance with the invention, a method is provided in which after the preset alarm thresholds of one or more fire identification characteristics have been exceeded and the fire-extinguishing device has been activated, at least one of the detectors detecting the fire identification characteristics is switched to a higher degree of sensitivity. The selection of the detector or detectors to be switched to a higher sensitivity is adapted to the further development of the fire in terms of space and time. Additional advantageous implementations of the invention are discussed below.

In accordance with the fire-extinguishing method as defined by the invention, after a fire has first been safely detected, the detectors of the fire alarm devices are switched to a raised stage of sensitivity by exceeding one or more preset alarm thresholds. In this way, the development of the fire may continue to be effectively detected despite the development of smoke, the formation of vapors caused by evaporating fire-extinguishing agents, or other interfering influences.

Furthermore, the invention relates to a fire alarm device as defined by the invention for carrying out the method of the invention.

The method can be applied in a particularly advantageous manner with the use of infrared detectors serving as sensitive flame detectors.

The heat radiation occurring in fires can still be safely detected by raising the sensitivity of an infrared detector according to the invention even if the permeability of its ambient air has been reduced due to the fire. Furthermore, a local selection of the detectors to be changed to a higher degree of sensitivity may be carried out after the fire has been progressing.

A lesser degree of sensitivity is required in areas with less development of smoke, or where the detector is installed with only little spacing from the source of the fire, than in areas where the development of smoke is strong or the detector is installed far from the source of the fire.

The control is effected via the behavior of the fire identification characteristics in terms of time.

In an advantageous further embodiment, the switch-over processes (signal evaluation of the detectors) for increasing the sensitivity of the detectors may be adjusted with a selectable time delay after the start of a fire has been detected.

This flexible adjustment possibility allows one to take into account the development of a fire to be expected. The system may be tailored with the degree of endangerment to the objects to be protected, of which the fundamental characteristics are known.

The individual change-over processes for switching the detectors to a higher stage of sensitivity are effected by a control unit arranged in the fire alarm devices, or initiated by the fire alarm center.

The measured data of the actual local fire development transmitted by the detectors are used for this purpose.

The increase of sensitivity may be accomplished in steps, i.e. incrementally, or it may be a stepless, continuous increase.

The local or spatial selection of the detectors to be switched to a raised sensitivity, is carried out following the evaluation and taking into account the measured data transmitted to the fire alarm center.

The fire-alarm devices may be installed in different locations and aligned in a manner corresponding with the structure of the expected fire hazard potential. In this way, the development of a fire can be continually analyzed in the course of the extinguishing process from a number of directions.

In another advantageous embodiment, a detector element may be additionally arranged in one or more fire-alarm devices for controlling the continuing application of the fire-extinguishing agent.

An application of the fire-extinguishing agent that is adequate for fighting a fire is detected by this additional detector element and generates an extinction stop-signal for shutting the fire-extinguishing system down.

Another advantageous implementation of the invention is connected with the known method of applying the fire-extinguishing agent in a cyclic manner, with controlled dispensing of the extinguishing agent.

Since the sensitivity of the detector is adapted to trailing the fire event according to the invention, an exact reproduction of the actual development of the fire is produced that corresponds with the actually measured data.

If the analysis of the data measured by the detectors indicates that the fire will continue, an elapsed extinction cycle of the fire-extinguishing system is restarted.

If fire is no longer detected despite the higher sensitivity of the fire-alarm devices, the generation (triggering) of the activation signals is discontinued as well and the extinction process is terminated.

To assure a more far-reaching safety for completely extinguishing a fire, an after-extinguishing cycle—the extent of which can be preset—may be triggered after an extinction stop-signal has been generated by the fire-alarm system.

The parameter adjustments for the after-extinguishing cycle, depend in this connection on the degree to which the objects to be protected are endangered. These parameter adjustments include the duration of the extinction process and the amount of extinguishing agent.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings.

DETAILED DESCRIPTION OF PREFERRED EMBODIMENTS

Figure 1:
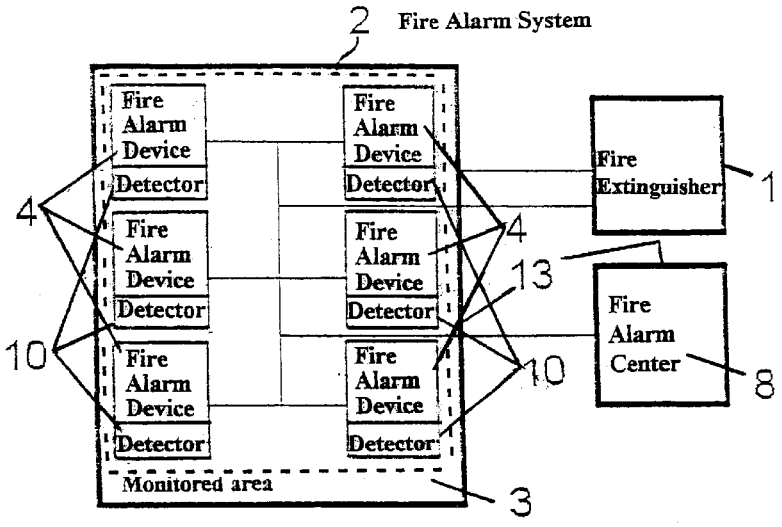
FIG. 1 shows the basic structure of a stationary fire-extinguishing system with a fire-alarm device and a fire-extinguishing device.

FIG. 1 shows the basic structure of a stationary fire-extinguishing system including a fire-extinguishing device 1 and a fire-alarm system 2. The fire-alarm system in particular includes a plurality of fire-alarm devices 4 and their signal lines 13. The important elements of this fire-alarm system are installed in the monitored area 3. A fire-alarm center 8 may be used to control fire-extinguishing device 1 and fire alarm devices 4. Fire-alarm system 2 may also include an additional detector element 10 as discussed in detail below.

Fire-extinguishing device 1 has a supply of fire-extinguishing agent which, in connection with gas fire-extinguishing systems, may include a plurality of pressurized-gas bottles. Fire-extinguishing device 1 also has a more or less branched system of pipelines for transporting the fire-extinguishing agent to the source of a fire in the monitored area. The mechanism for triggering the extinction process, for example a fire-alarm valve station, is connected to fire-alarm system 2 via signal lines 13. Fire-alarm system 2 may include one or more fire-alarm devices 4, in which one or more of detectors 5, 6 with an identical or different type of construction are integrated. Detectors 5, 6 preferably take the form of optical radiation detectors; their sensitivity to radiation is in the range of the infrared or ultraviolet wavelength.

Additional components 7 for controlling and processing the signals of detectors 5, 6 and fire-extinguishing device 1 are integrated in the fire-alarm devices as well.

For larger stationary fire-extinguishing systems, a fire-alarm center 8 assumes the control of fire-extinguishing device 1, as well as the evaluation of the detector signals of the individual fire-alarm devices 4.

Figure 2:
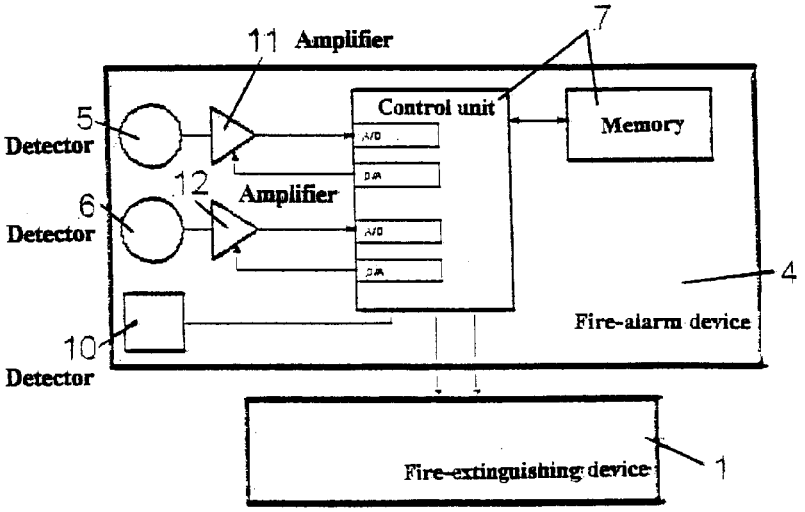
FIG. 2 shows a fire-alarm device comprising an electronic control and detectors.

As shown in FIG. 2, each fire-alarm device 4 includes an electronic control with a memory 7 and detectors 5, 6. In this embodiment, control unit 7, which controls the fire-extinguishing device 1, is integrated in fire-alarm device 4. Fire-alarm device 4 is connected with fire-extinguishing device 1 via signal lines 13 as shown in FIG. 2. Detectors 5, 6 are coupled through respective amplifier circuits 11, 12 to control unit 7.

To prevent the triggering of false alarms of the fire-extinguishing device by interfering influences (for example by infrared radiation sources), amplifier circuits 11 and 12 of detectors 5 and 6, respectively, are adapted to the environmental conditions of the fire-alarm device.

Such an adaptation (temperature compensation, trailing of the no-signal (or resting) value) can be obtained, for example, with the help of digital/analog converters, which are controlled by control unit 7 of fire-alarm device 4.

If increased radiation values from monitored area 3 are measured by means of one or more of the detectors 5 and 6 and a pre-defined alarm threshold value is exceeded, fire-alarm device 4 transmits an alarm signal to fire-extinguishing device 1 and activates the automatic fire-extinction process.

It may be entirely useful in this connection if still-adjustable pre-alarm stages are switched before the automatic extinguishing process is activated, or to use additional fire identification characteristics for detecting a fire.

Detectors 5, 6 can be usefully arranged individually or jointly in a fire-alarm device 4 and may detect the same or different fire identification characteristics (type A or type B). For example, detector 5 may be a type A detector and detector 6 may be a type B detector, or both may be type A or type B.

After fire-extinguishing device 1 has been activated, detectors 5 and 6 are set to a higher degree of sensitivity by means of amplifiers 11 and 12 (A and B), respectively.

It is possible in this way to detect the further development of the fire through the forming smoke or vapor or extinguishing mist. The "fire detected" signal 9 by a fire-alarm device 4 will control or trigger fire-extinguishing device 1 to continue as discussed below.

Figure 3:
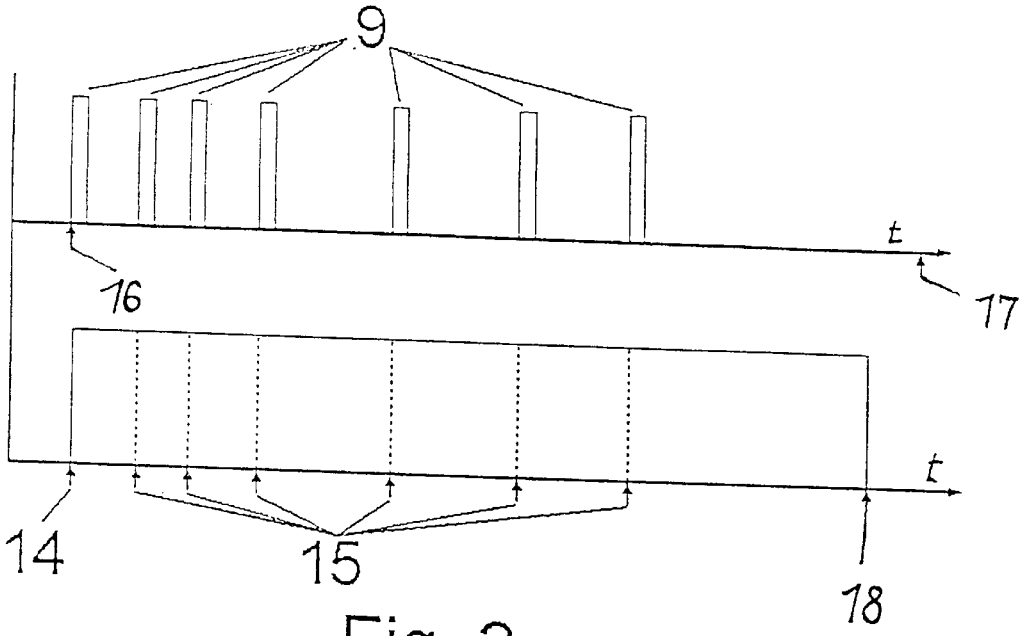
FIG. 3 shows a time flow diagram of the fire-extinguishing method as defined by the invention.

FIG. 3 shows a time flow diagram of the fire-extinguishing method according to the invention. The start of the fire-extinction process is designated by 14. After-extinction cycles take place at 15. The point at which switching to a higher sensitivity is effected is designated by 16. Normal sensitivity on the time axis resumes at 17. The extinction stop where after-extinction time has elapsed is designated by 18.

As shown in FIG. 3, as long as the detectors of the fire-alarm device detect the fire during an increased sensitivity stage 9 (FIG. 3), the control (triggering) of fire-extinguishing device 1 is continued and a pre-set fire extinction cycle 15 is re-started. Thus the fire-extinction process may include a great number of fire-extinction cycles 15. The fire-extinction process is thus continued until the detectors no longer detect any fire. After the end of the fire has been detected, fire-alarm devices 4 will no longer transmit any trigger signals to fire-extinguishing device 1. The extinction process is then deactivated after a preset after-extinguishing time has elapsed.

The preset after-extinguishing time 18 is activated by means of the extinction stop-signal generated by control unit 7.

After the after-extinction time has elapsed at time 18, the detectors are subsequently reset to the normal (preset) sensitivity at time 17 by means of the amplifiers 11 and 12.

Fire-alarm system 2, in particular its fire-alarm devices 4, may be additionally equipped with an additional suitable detector element 10 for monitoring the application of the fire-extinguishing agent in the event of a fire and causing an "extinction stop" signal to be generated as well, as discussed below.

If an application of fire-extinguishing agent adequate for fighting the fire has been detected by detector element 10, an extinction stop-signal is generated and a preset after-extinction time is activated.

The application of fire-extinguishing agent is adequate if, for example in connection with a gas-type fire-extinguishing system, the concentration ($CO_2$ gas) of the extinguishing gas is adequately high for quenching the fire.

A $CO_2$-sensor or an $O_2$-sensor in a gas fire-extinguishing system, for example, can be employed as a suitable detector element 10 for monitoring the application of the fire-extinguishing agent.

Depending on the design of the stationary fire-extinguishing system, the extinction stop-signal of detector element 10 is processed either in control unit 7 of fire-alarm device 4 or in a fire-alarm center 8 and transmitted to fire-extinguishing device 1.

The fire-extinguishing method as defined by the invention particularly offers the advantage that the application of the fire-extinguishing agent takes place in a highly targeted manner, and is adapted to the development of a fire. Once the fire has been successfully fought, the feed of fire-extinguishing agent is discontinued and further damage to persons or equipment is avoided. The amount of fire-extinguishing agent consumed is distinctly reduced.

The continuous or incremental increase in the sensitivity of the detectors of the fire-alarm devices after the first alarm has been triggered permits a differentiated evaluation of the actual fire event.

While only a few embodiments of the present invention have been shown and described, it is to be understood that many changes and modifications may be made thereunto without departing from the spirit and scope of the invention as defined in the appended claims.

What is claimed is:

1. A method for controlling a stationary fire-extinguishing system having a fire-extinguishing device and a fire-alarm system having at least one fire-alarm device with at least one detector, said at least one detector detecting identical or different fire identification characteristics and triggering an alarm signal activating the fire-extinguishing device when at least one pre-adjustable alarm threshold of the detected fire identification characteristics is exceeded, wherein a detector element for monitoring continuing application of a fire-extinguishing agent is connected with at least one fire-alarm device, said detector element generating a fire-extinction stop-signal when application of the fire-extinguishing agent is adequate for fighting the fire and transmitting said signal to a control system to terminate fire-extinction, comprising the steps of:

(a) activating the fire-extinguishing device after said at least one pre-adjustable alarm threshold of a fire being detected has been exceeded;

(b) subsequently switching at least one detector to a higher degree of sensitivity, said at least one detector being selected to be switched to the higher sensitivity based on developing characteristics of the fire being detected over space and time;

(c) following a first activation of the fire-extinguishing device and switching of the fire-alarm system to a higher sensitivity stage, and after a first five-extinction cycle has elapsed, transmitting by the fire-alarm system activation signals serving as trigger pulses to the fire-extinguishing device at variable time intervals if a fire hazard continues to exist, said trigger pulses restarting an elapsed fire-extinction cycle; and (d) repeating the fire-extinction cycles until an end of the fire has been detected.

2. The method according to claim 1, wherein the step of switching at least one detector to an increased sensitivity is effected simultaneously with the activation of the fire-extinguishing device or with a variably selectable delay in time after such activation.

3. The method according to claim 1, wherein the fire-extinguishing system comprises a control unit arranged in said at least one fire-alarm device or in a fire-alarm center coupled to said at least one fire-alarm device, said control unit evaluating detector signals of said at least one detector, adjusting the sensitivity of said at least one detector, and selecting the detectors to be switched to the higher degree of sensitivity for an optimal detection fire development.

4. The method according to claim 1, wherein said at least one detector is switched to an increased sensitivity incrementally or continuously.

5. The method according to claim 4, wherein said at least one fire-alarm device or said at least one detector is arranged in different locations and disposed with an alignment corresponding with an expected fire hazard, and the method further comprises the steps of continually analyzing fire development during extinguishment from several directions, and emitting an extinction stop-signal upon termination of the fire.

6. The method according to claim 1, wherein after the end of the fire has been detected, the control system of the fire-alarm system or the fire-alarm device transmits an extinction stop-signal to the fire-extinguishing device, thereby triggering a preset after-extinction cycle.

* * * * *

UNITED STATES PATENT AND TRADEMARK OFFICE

CERTIFICATE OF CORRECTION

PATENT NO. : 6,788,208 B2
DATED : September 7,2004
INVENTOR(S) : Hauke Dittmer

It is certified that error appears in the above-identified patent and that said Letters Patent is hereby corrected as shown below:

Column 8,
Line 20, after the word "first", please change "five-extinction" to correctly read -- fire-extinction --.

Signed and Sealed this

Nineteenth Day of October, 2004

JON W. DUDAS
*Director of the United States Patent and Trademark Office*